US008197271B2

(12) United States Patent
Kobayashi et al.

(10) Patent No.: US 8,197,271 B2
(45) Date of Patent: Jun. 12, 2012

(54) LEVER ENGAGEMENT TYPE CONNECTOR

(75) Inventors: Tohru Kobayashi, Makinohara (JP); Hiroshi Miyazaki, Tokyo (JP)

(73) Assignee: Yazaki Corporation, Tokyo (JP)

( * ) Notice: Subject to any disclaimer, the term of this patent is extended or adjusted under 35 U.S.C. 154(b) by 4 days.

(21) Appl. No.: 12/871,267

(22) Filed: Aug. 30, 2010

(65) Prior Publication Data

US 2011/0086533 A1 Apr. 14, 2011

(30) Foreign Application Priority Data

Oct. 8, 2009 (JP) ..... 2009-234430

(51) Int. Cl.
*H01R 13/62* (2006.01)

(52) U.S. Cl. ..... 439/157; 439/372

(58) Field of Classification Search ..... 439/157, 439/372

See application file for complete search history.

(56) References Cited

U.S. PATENT DOCUMENTS 6,126,470 A * 10/2000 Ono ..... 439/310
6,602,082 B2 * 8/2003 Nishide et al. ..... 439/157
6,733,312 B2 * 5/2004 Fujii ..... 439/157
6,755,674 B2 * 6/2004 Fujii et al. ..... 439/157
7,267,564 B2 * 9/2007 Bauman et al. ..... 439/157
2003/0176090 A1 9/2003 Kozono et al.

FOREIGN PATENT DOCUMENTS

JP 2003-272768 A 9/2003

* cited by examiner

*Primary Examiner* — Thanh Tam Le
(74) *Attorney, Agent, or Firm* — Sughrue Mion, PLLC

(57) ABSTRACT

A lever engagement type connector includes a first connector housing having a retaining portion and a second connector housing. A lever formed with a cam groove is rotatably attached to the first connector housing. An engagement pin engaged with the cam groove is projected on the second connector housing. A wire cover is attached to the first connector housing. An engagement portion engaged with the retaining portion is provided in the wire cover. The lever is formed with a jig insertion hole at a position where an engagement area between the retaining portion and the engagement portion is covered by the lever in a state that the lever is disposed at a position other than a predetermined position.

2 Claims, 22 Drawing Sheets

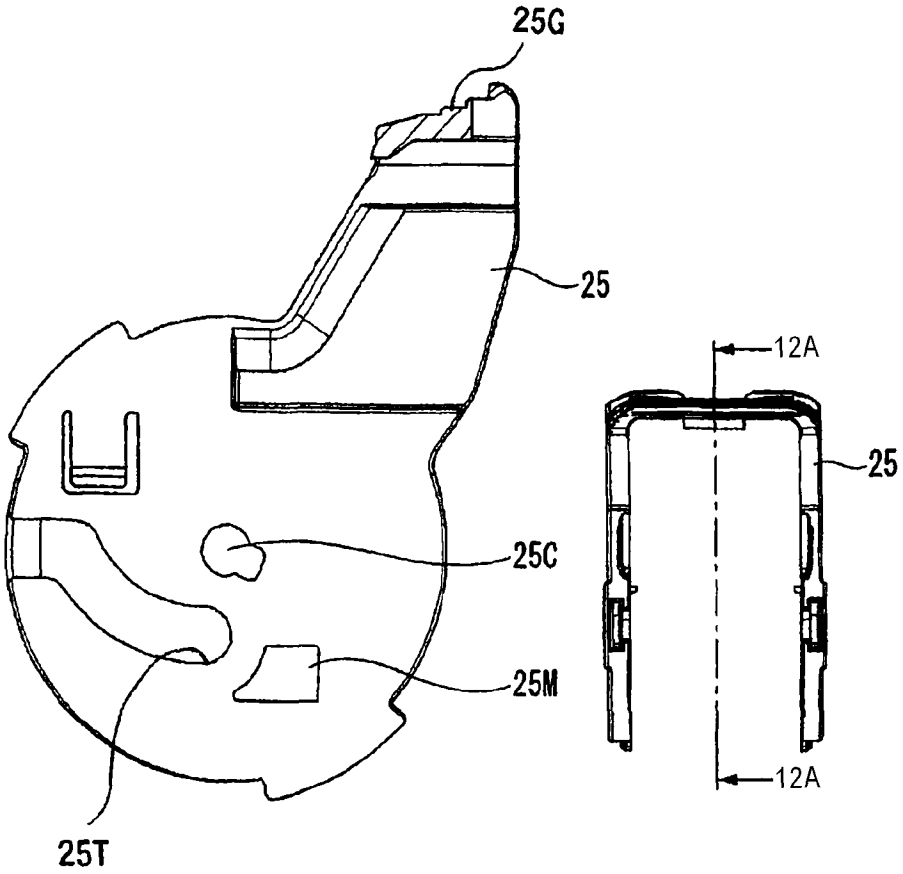
Fig. 12B
Fig. 12C
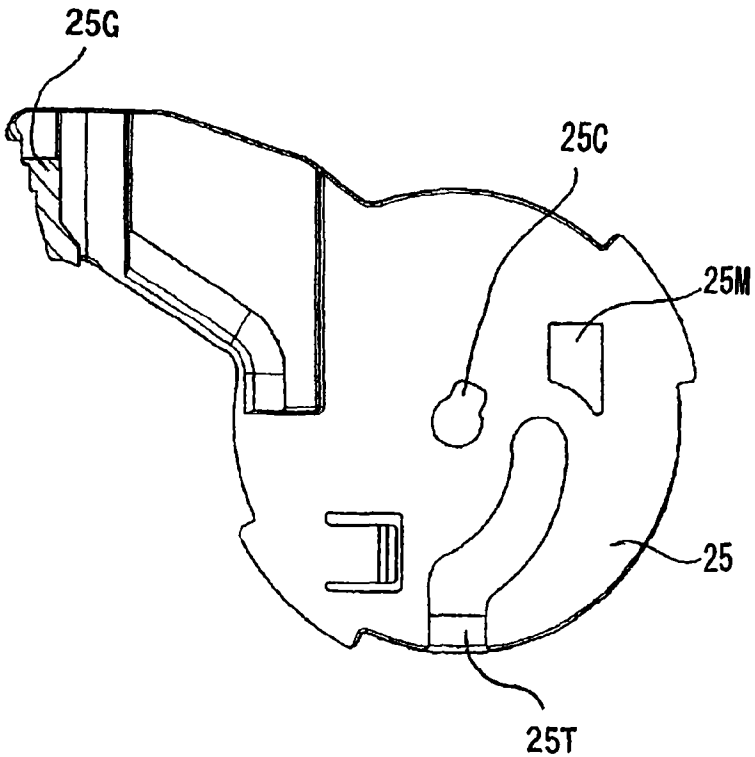
Fig. 12A

LEVER ENGAGEMENT TYPE CONNECTOR

BACKGROUND

The present invention relates to a lever engagement type connector provided with a wire cover separation preventing function, and more particularly to a lever engagement type connector with a wire cover separation preventing function in which a wire cover is prevented from becoming inadvertently separated at the time of complete engagement of a connector.

The lever engagement type connector to which the invention is applied is a connector with a wire cover which is comprised of a male connector, a wire cover, and a female connector with a lever. The lever engagement type connector is arranged such that a lever with a cam groove is pivotally supported on one connector (e.g., female connector) of a pair of connectors which are engaged with each other, an engaging pin which engages with this cam groove is projected on the other connector (e.g., male connector), and if the lever is pivotally manipulated, the engagement and separation of the both connectors are assisted by the engagement between the engaging pin and the cam groove. The lever engagement type connector itself is publicly known (refer to Patent Document 1).

FIGS. 15 to 23 show an example of a conventional lever engagement type connector with a wire cover.

FIG. 15 is an exploded perspective view of the conventional connector with a wire cover. This connector C100 with a wire cover is comprised of a male connector 100; a female connector 200 which is engaged with this male connector 100; a wire cover 300 for covering a multiplicity of wires which are led out from a side of this female connector 200 which is away from its male connector side and for changing the leading-out direction of the wires to an orthogonal direction; and a lever 250 for effecting engagement between the male connector 100 and the female connector 200 with low friction and for holding the engaged state. This lever 250 is turnably mounted on the female connector 200.

FIG. 16 is a cross-sectional plan view illustrating a state in which the wire cover 300 is fitted to the female connector 200. FIG. 17 is an enlarged view of an engaging portion shown in FIG. 16.

In FIGS. 16 and 17, as a retaining projection 300K provided on the wire cover 300 is engaged with a retaining arm 200K provided on the female connector 200, the wire cover 300 is fitted to the female connector 200.

The shapes and places of disposition of the retaining arm 200K and the engaging projection 300K are not particularly limited.

FIG. 18A is a front elevational view of a state in which the wire cover 300 is fitted to the female connector 200, and FIG. 18B is a cross-sectional view taken along line 18A-18A in the direction of arrows in FIG. 18A. FIG. 19 is an enlarged view of a portion where the lever 250 in FIG. 18B is temporarily engaged with the female connector 200.

The lever 250 in FIG. 18A is adapted to rotate on the female connector 200 by using its rotational center 250C as an axis.

When a retaining lock 250R provided on the lever 250 is engaged with a retaining lock 200R provided on the female connector 200, the lever 250 maintains its temporarily retained state, as shown in FIG. 18B.

FIG. 20A shows a state in which the male connector 100 is temporarily engaged with the female connector 200, and FIG. 20B shows a state in which the male connector 100 is completely engaged.

In FIG. 20A, an inserting portion of the male connector 100 is inserted from below into an insertion port provided on the lower side of the female connector 200, and a temporarily engaged state is thereby maintained. At this time, a grip 250G of the lever 250 which is pivotally supported on the female connector 200 is oriented in an orthogonal direction (horizontal direction in the drawing) with respect to the engaging direction (vertical direction in the drawing) of the connector.

After the temporary engagement of the male connector 100 as shown in FIG. 20A, if the grip 250G of the lever 250 is rotated from the horizontal direction in the direction indicated by arrow P1 in FIG. 20B by using the rotational center 250C of the lever 250 as an axis, and is thereby set vertically, a retaining projection 100T formed in the vicinity of the center of a lower portion of the male connector 100 is fitted during the rotation of the lever 250 into a cam opening 250T formed in the vicinity of the opposite side of the rotational center 250C of the lever 250 to the grip 250G. Consequently, the male connector 100 is raised while the retaining projection 100T is guided by an end portion of the cam opening 250T in conjunction with the rotation of the lever 250.

FIG. 21A is a plan view, taken from above, of the engaged state of the connector shown in FIG. 20B, and FIG. 21B is an enlarged cross-sectional view taken along line 21B-21B in the direction of arrows in FIG. 21A.

If the rotation of the lever 250 is further continued, a retaining lock 250L provided on the lever 250 rides over a retaining lock 300L provided on the wire cover 300 and is engaged with the retaining lock 300L. At this time, the raising movement of the male connector 100 is finished, and the male connector 100 and the female connector 200 are in a completely engaged state.

In FIG. 21B, a slope 250S is formed on the obverse side in the rotating direction of the lever retaining lock 250L, while a slope 300S is also formed on the retaining lock side of the retaining lock 300L of the wire cover 300. Therefore, during the rotation, the both slopes 250S and 300S undergo relative movement while coming into contact with each other with low contact resistance, and the lever retaining lock 250L finally rides over the retaining lock 300L and is engaged with the retaining lock 300L.

FIG. 22 shows a state in which the male connector 100 and the female connector 200 are completely engaged. FIG. 23A is a cross-sectional plan view of the connector shown in FIG. 22, and FIG. 23B is an enlarged view of an inserting portion shown in FIG. 23A.

To disengage the completely engaged connector, the lever 250, which has been rotated to the position of rotation completion as shown in FIG. 22 and FIG. 20B, is rotated in the reverse direction up to its initial position of rotation, thereby canceling the complete engagement of the two connectors 100 and 200 and setting the both connectors 100 and 200 in the temporarily engaged state.

With the wire cover 300 of the conventional connector, even in the connector is thus in the completely engaged state, since an engaging portion R between the female connector 200 and the wire cover 300 is exposed, as shown in FIG. 22, a disengaging jig G can be easily inserted into the engaging portion R. Therefore, if the disengaging jig G is inserted into the engaging portion R between the female connector 200 and the wire cover 300, the engaging projection 300K of the wire cover 300 rides over the engaging projection 200K of the female connector 200. In consequence, the engagement is canceled, and the wire cover 300 is separated from the female connector 200. If the engaging portion R is exposed in this manner, there has been a possibility that foreign substances can enter.

[Patent Document 1] Japanese Patent Publication Number 2003-272768 A

SUMMARY

It is therefore one advantageous aspect of the present invention to provide a connector in which the wire cover cannot be inadvertently separated from the connector housing.

According to one aspect of the invention, there is provided a lever engagement type connector, comprising;

a first connector housing having a retaining portion;

a second connector housing;

a lever rotatably attached to the first connector housing and formed with a cam groove;

an engagement pin projected on the second connector housing and configured to be engaged with the cam groove;

a wire cover attached to the first connector housing; and an engagement portion provided in the wire cover and configured to be engaged with the retaining portion, wherein the lever is formed with a jig insertion hole at a position where an engagement area between the retaining portion and the engagement portion is covered by the lever in a state that the lever is disposed at a position other than a predetermined position.

The predetermined position may be an initial rotational position of the lever.

The retaining portion may be a retaining projection formed on the first connector housing, and the engagement portion may be an engagement arm which is formed with an engagement projection and deformable.

The engagement projection may be formed with a key groove, and a tip of a disengaging jig may be inserted into the key groove through the jig insertion hole.

BRIEF DESCRIPTION OF THE DRAWINGS

FIG. 12A is a front elevational view, taken from the inner side, of the lever.

FIG. 12B is a view taken from the inner side along line 12A-12A in the direction of arrows in FIG. 12C.

FIG. 12C is a front elevational view of the lever.

DETAILED DESCRIPTION OF EXEMPLIFIED EMBODIMENTS

Referring to FIGS. 1 to 14, a description will be given of an embodiment of the invention in which a disengaging jig is made unable to be inserted into a gap between engaging portions of a female connector and a wire cover unless a lever is in its initial rotational position so as to prevent the wire cover from being inadvertently separated from a connector housing.

Figure 1:
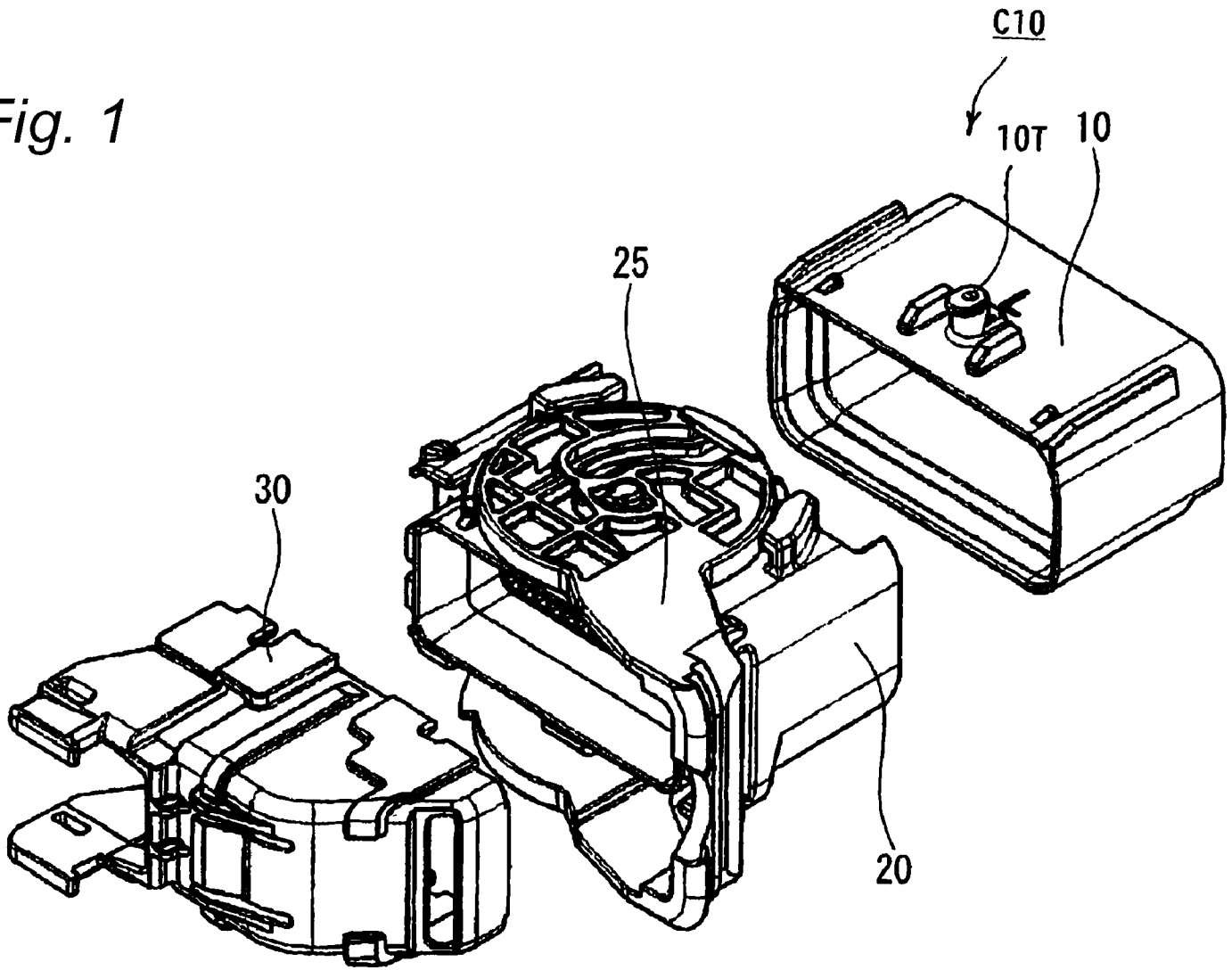
FIG. 1 is an exploded perspective view of the connector in accordance with the invention.

FIG. 1 is an exploded perspective view of the connector in accordance with the invention.

In FIG. 1, a connector C10 in accordance with the invention is comprised of a male connector 10; a female connector 20 which is engaged with this male connector 10; a wire cover 30 for covering a multiplicity of wires which are led out from a side of this female connector 20 which is away from its male connector side and for changing the leading-out direction of the wires to an orthogonal direction; and a lever 25 which is turnably mounted on the female connector 20 so as to hold a state of complete engagement between the male connector 10 and the female connector 20.

Referring to FIGS. 2 to 5, a description will be given of the process up to the fitting of the wire cover 30 to the female connector 20 and retention of mutual retaining parts.

Figure 2:
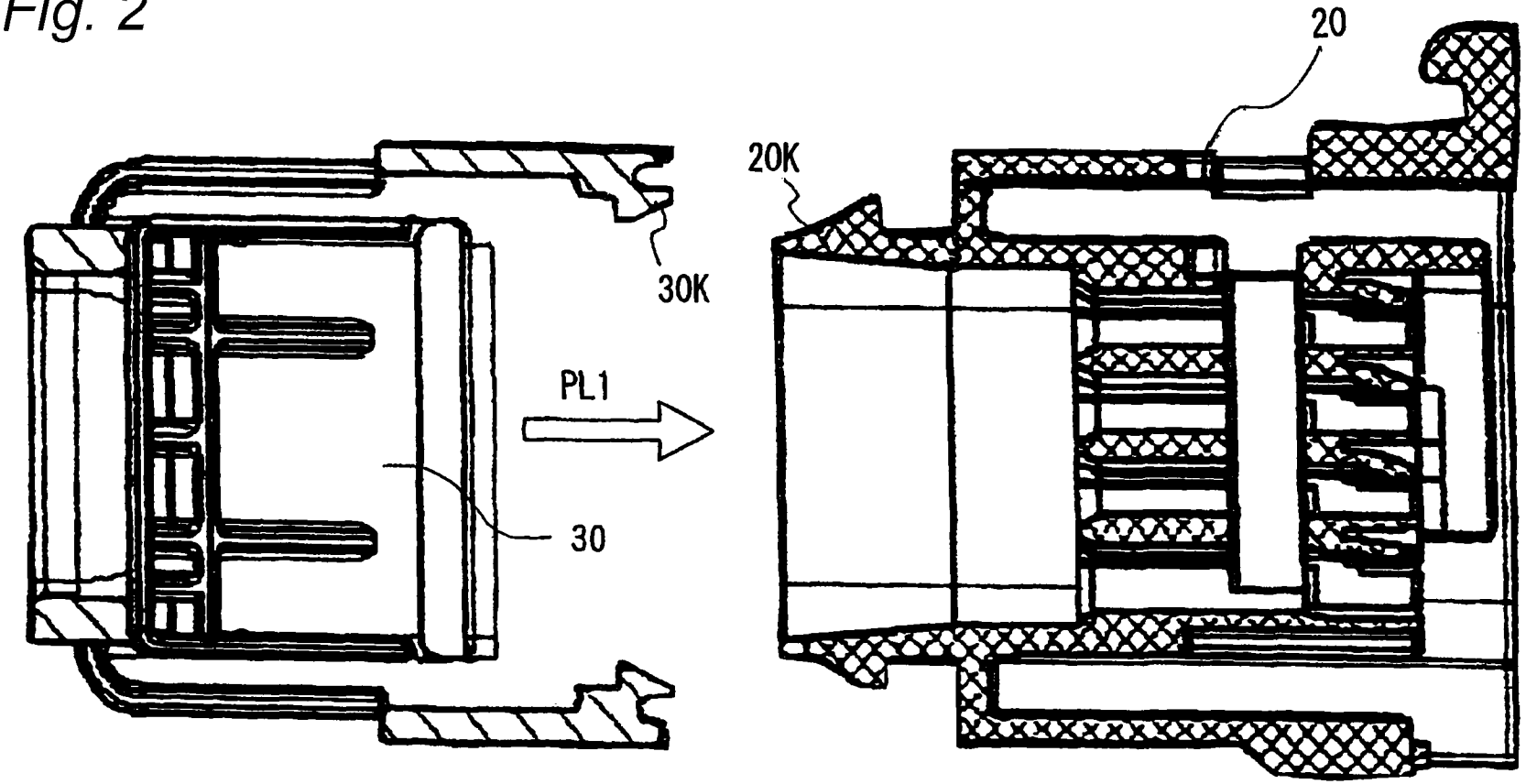
FIG. 2 is a cross-sectional plan view illustrating a state in which a wire cover is being made to approach a female connector so as to be retained thereby.

FIG. 2 is a cross-sectional plan view illustrating an interim state in which the wire cover 30 is being made to approach in the direction of an arrow PL1 to retain the wire cover 30 to the female connector 20. Since the wire cover 30 and the female connector 20 are in a prefitting state in which they are spaced apart from each other, the lever 25 mounted on the female connector 20 is not depicted in FIGS. 2 and 3 to facilitate an understanding of respective profile shapes of the female connector 20 and the wire cover 30.

In FIG. 2, the female connector 20 has a pair of retaining projections 20K, and the wire cover 30 is provided with a pair of flexurally deformable engaging arms for engagement with these retaining projections 20K, an engaging projection 30K being provided on each of their distal ends. A slant surface is formed on each of the retaining projections 20K and the engaging projections 30K at their initially contacting portions. Thus, each of the retaining projection 20K and the engaging projection 30K has a substantially rectangular triangle such that after the slant surfaces have ridden over each other, orthogonal cliff surfaces continue.

Figure 3:
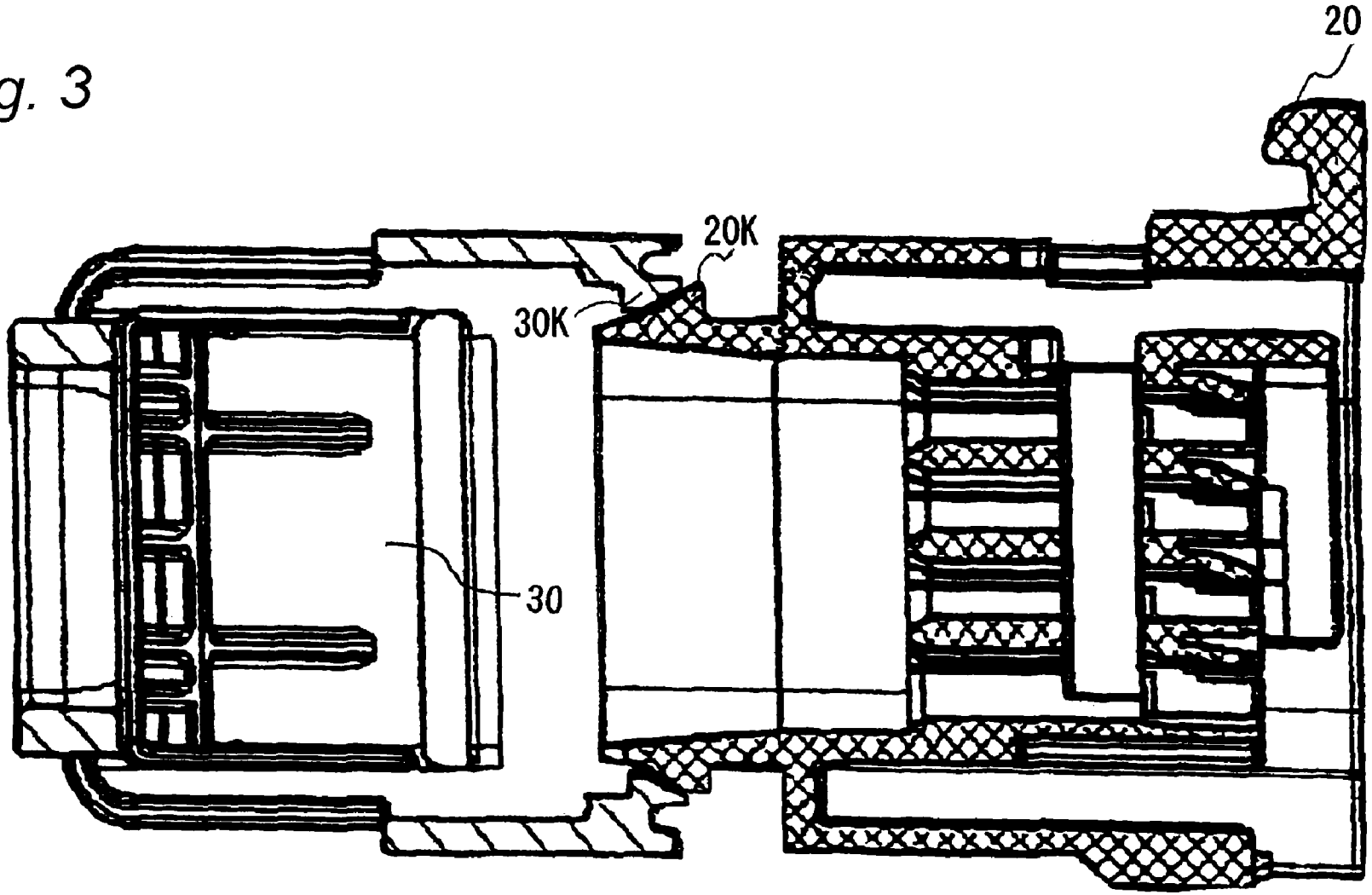
FIG. 3 is a cross-sectional plan view illustrating a state in which a slant surface of the retaining projection of the female connector and a slant surface of a flexurally deformable engaging arm of the wire cover are brought into contact with each other.

FIG. 3 is a cross-sectional plan view illustrating a state in which the slant surface of the retaining projection 20K of the female connector 20 and the slant surface of the engaging projection 30K of the wire cover 30 are brought into contact with each other. Thereafter, the slant surface of the retaining projection 20K and the slant surface of the engaging projection 30K ride over the slant surfaces while being deflected respectively inwardly and outwardly due to the resiliency of their own material, and when the slant surfaces ride over each other, the retaining projection 20K and the engaging projection 30K are engaged with each other.

Figure 4:
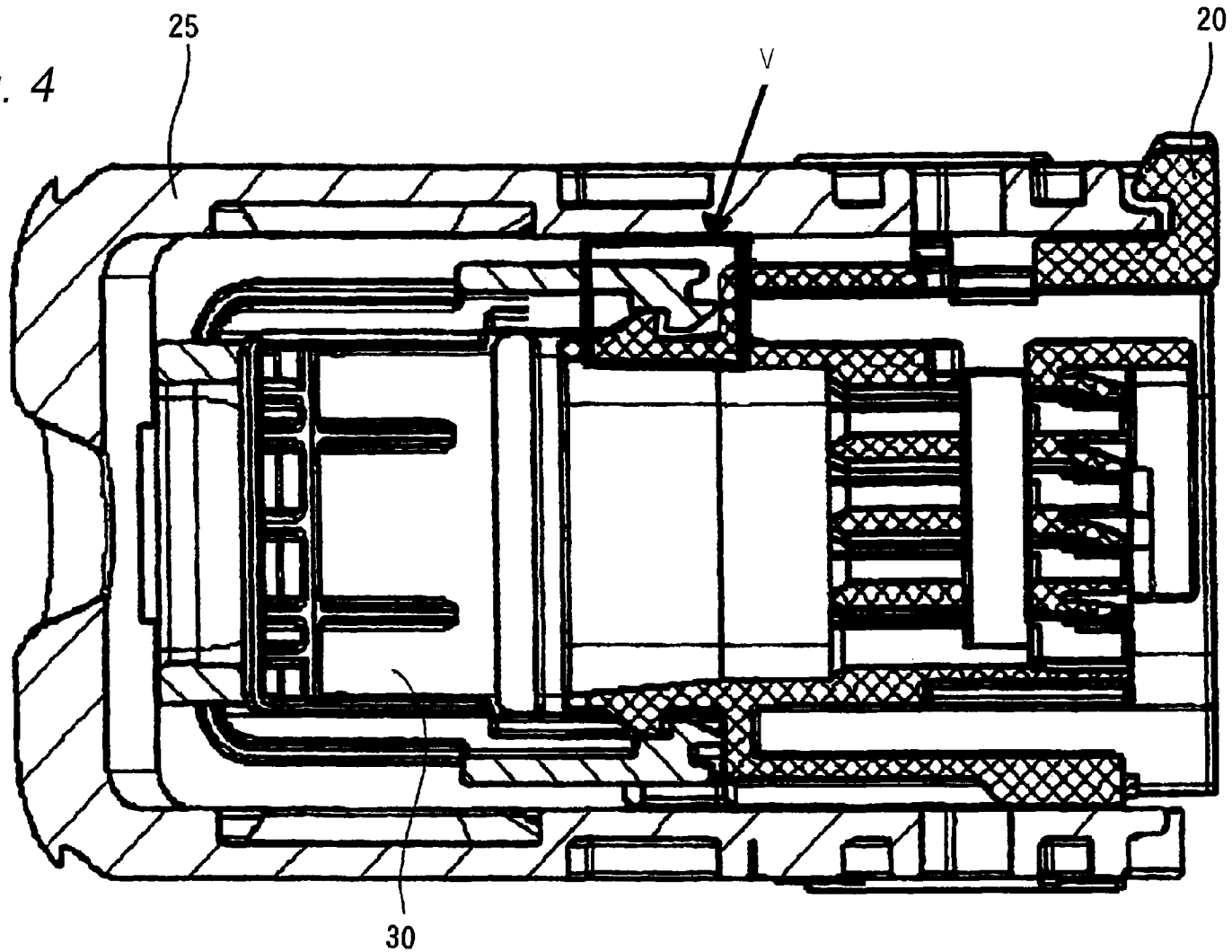
FIG. 4 is a cross-sectional plan view illustrating a state in which the wire cover 30 is fitted to the female connector.
Figure 5:
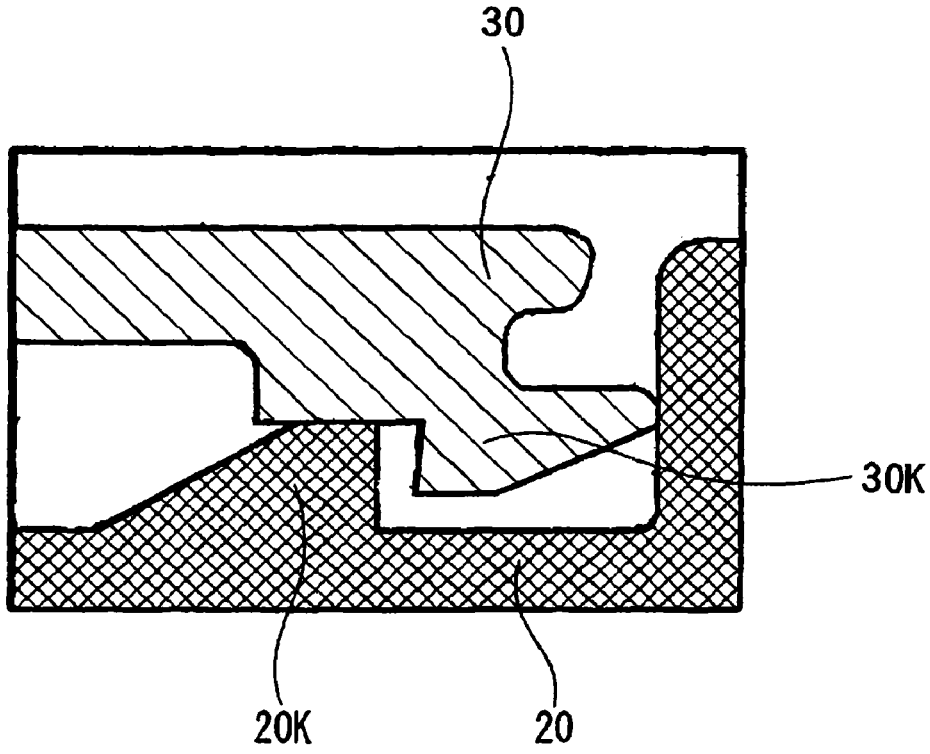
FIG. 5 is an enlarged view of an engaging portion between the retaining projection and a distal end portion of the engaging arm in this case, and is an explanatory diagram at the time of an engaged state.

FIG. 4 is a cross-sectional plan view illustrating a state in which the wire cover 30 is fitted to the female connector 20. In this state, the lever 25 is located on the outer periphery of the wire cover 30. FIG. 5 is an enlarged view of that portion of FIG. 4 which is surrounded by a rectangle and indicated as V, i.e., engaged portions of the retaining projection 20K and the engaging projection 30K.

In FIG. 4, the wire cover 30 is fitted to the female connector 20. As shown in FIG. 5, in order to maintain this state, the retaining projection 20K of the female connector 20 and the engaging projection 30K of the wire cover 30 are opposed to each other at their cliff surfaces and are thereby prevented from coming off from each other in opposite directions.

To disengage the wire cover 30 from the female connector 20 from the state in which the slant surface of the retaining projection 20K of the female connector 20 and the slant surface of the engaging projection 30K of the wire cover 30 are opposed to each other and are thus prevented from coming off from each other in opposite directions, it suffices if, by using a disengaging jig G, the disengaging jig G is inserted into a gap between the female connector 20 and the wire cover 30, is further inserted into a key groove 30M formed in the vicinity of the engaging projection 30K of the wire cover 30, and is lifted upward. By so doing, the engaging projection 30K of the wire cover 30 rides over the engaging projection 20K of the female connector 20, so that the engagement is canceled, and the wire cover 30 is disengaged from the female connector 20 and can be separated.

Figure 6A:
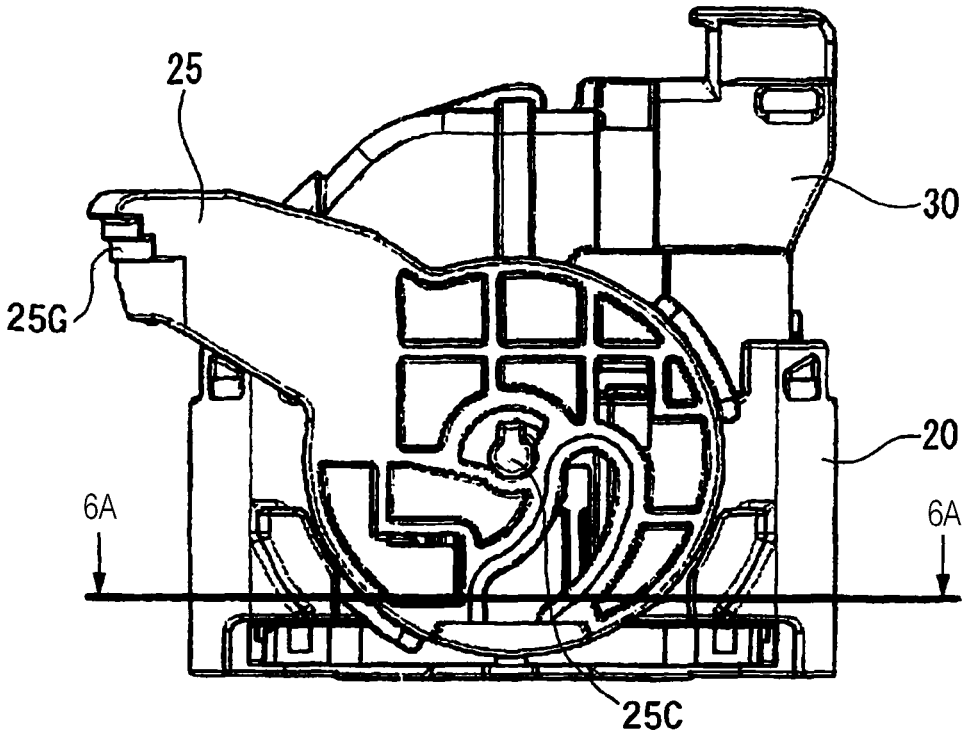
FIG. 6A is a plan view of a state in which the wire cover is fitted to the female connector.
Figure 6B:
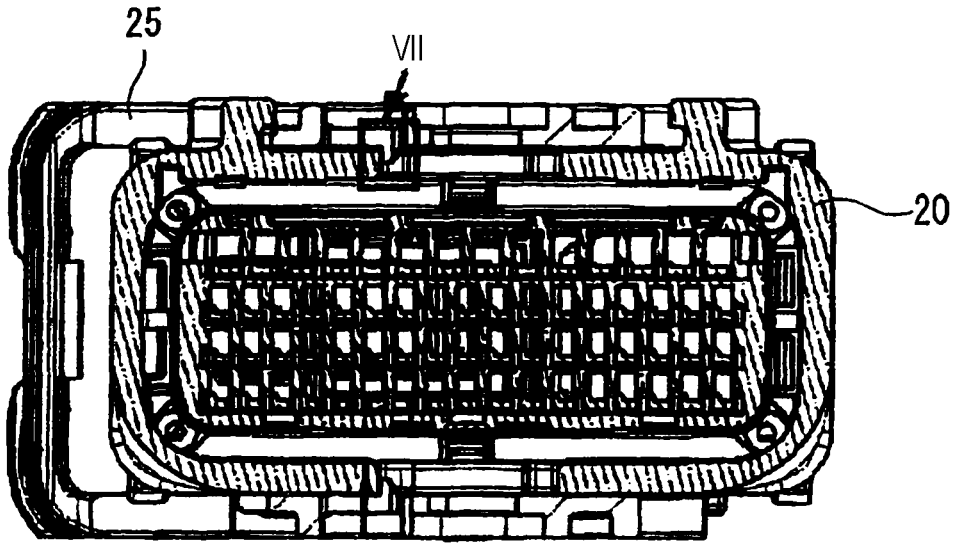
FIG. 6B is a cross-sectional view taken along line 6A-6A in the direction of arrows in FIG. 6A.
Figure 7:
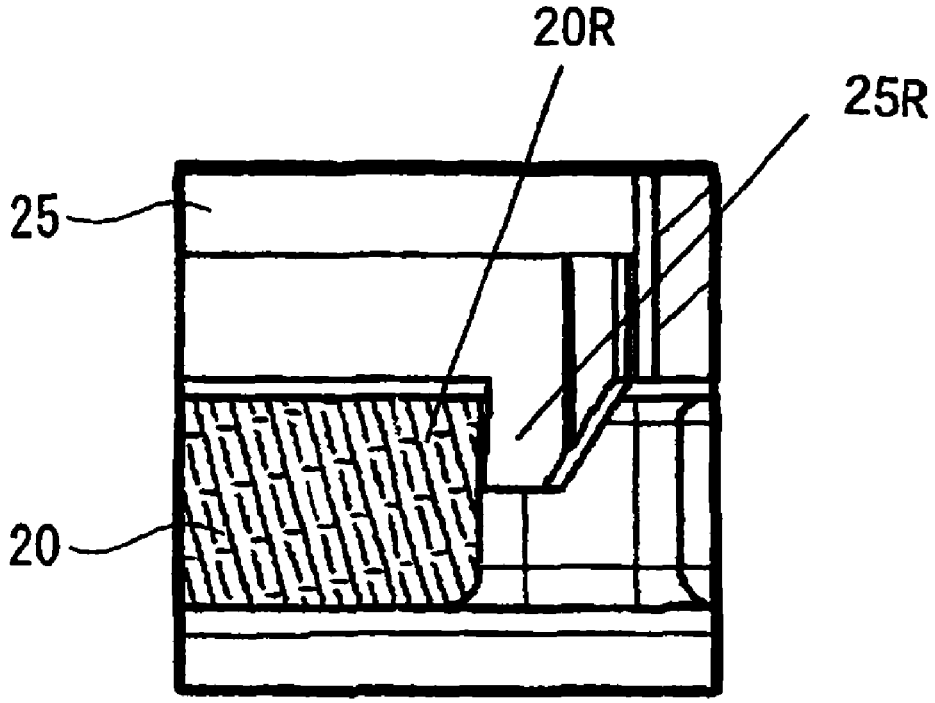
FIG. 7 is an enlarged view of the portion where the lever in FIG. 6B is temporarily engaged with the female connector.

FIG. 6A is a plan view of a state in which the wire cover 30 is fitted to the female connector 20. FIG. 6B is a cross-sectional view taken along line 6A-6A in the direction of arrows in FIG. 6A. FIG. 7 is an enlarged view of the portion VII where the lever 25 in FIG. 6B is temporarily engaged with the female connector 20.

In FIG. 6A, in the state in which the wire cover 30 is fitted to the female connector 20, a grip 25G of the lever 25 faces the 10 o'clock direction in a clock as viewed from a rotational center 25C. In this state, the lever 25 is in a state of being temporarily retained by the female connector 20. Namely, as for the lever 25 engaged with the female connector 20 in FIG. 6B, a retaining lock 25R of the lever 25 is engaged with a retaining lock 20R provided on the female connector 20, as shown in FIG. 7, and the temporarily retained state is thereby maintained.

Such a temporarily retained state of the lever is set as a standby state, and the male connector 10 is temporarily engaged with the female connector 20. FIG. 8A shows a state in which the male connector 10 is temporarily engaged with the female connector 20. In FIG. 8A, an inserting portion of the male connector 10 is inserted from below into an insertion port provided on the lower side of the female connector 20, and a temporarily engaged state is thereby maintained. At this time, the grip 25G of the lever 25 still faces the 10 o'clock direction of a clock in the drawing.

Figure 8B:
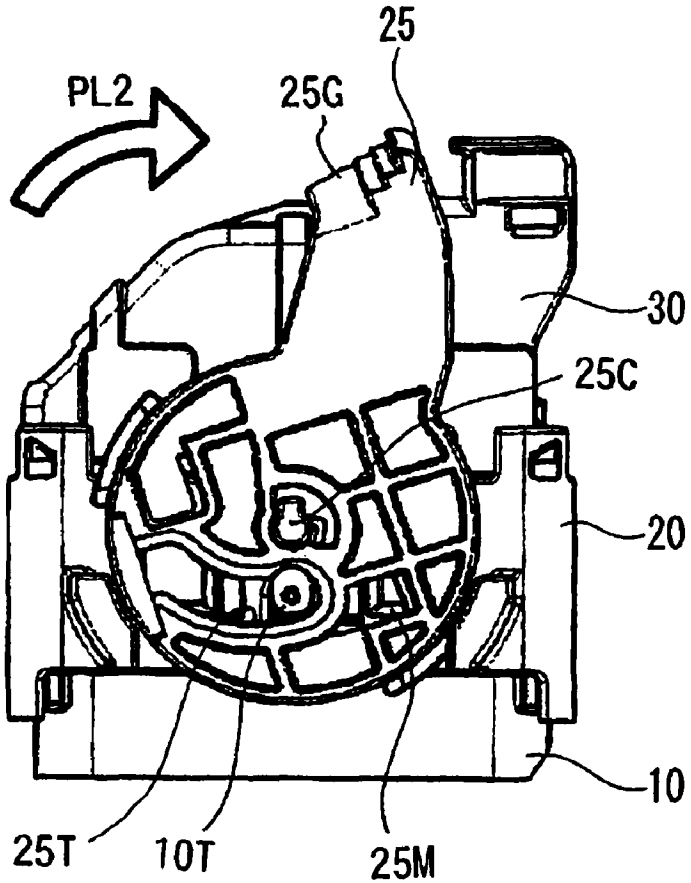
FIG. 8B is a diagram illustrating a state in which the male connector is completely engaged with the female connector.
Figure 8A:
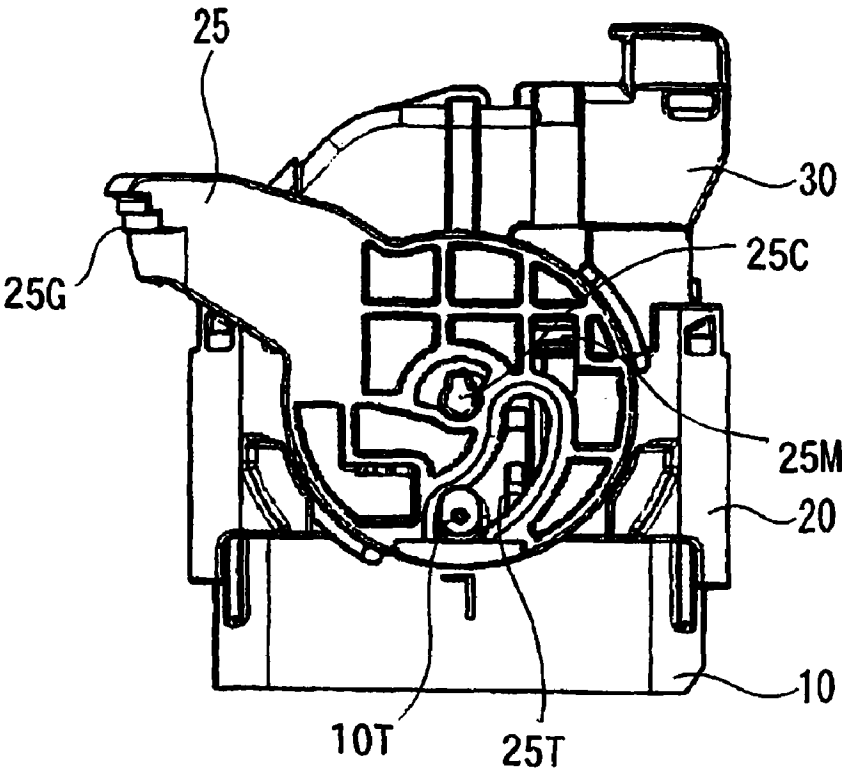
FIG. 8A is a diagram illustrating a state in which the male connector is temporarily engaged with the female connector.

After the temporary engagement of the male connector 10 as shown in FIG. 8A, if the grip 25G of the lever 25 is rotated from the 10 o'clock direction of a clock in the drawing in the direction indicated by arrow PL2 in FIG. 8B by using the rotational center 25C of the lever 25 as an axis, and is thereby set in the direction of 12 o'clock, a retaining projection 10T formed in the vicinity of the center of a lower portion of the male connector 10 is fitted during the rotation of the lever 25 into a curved cam opening 25T formed in the vicinity of the opposite side of the rotational center 25C of the lever 25 to the grip 25G. Consequently, the male connector 10 is raised while the retaining projection 10T is guided by an end portion of the curved cam opening 25T in conjunction with the rotation of the lever 25. When a retaining lock 25L provided on the lever 25 rides over a retaining lock 30L provided on the wire cover 30 and is engaged with the retaining lock 30L, the upward movement of the male connector 10 stops, and at this time the male connector 10 and the female connector 20 are in a completely engaged state.

Figure 9B:
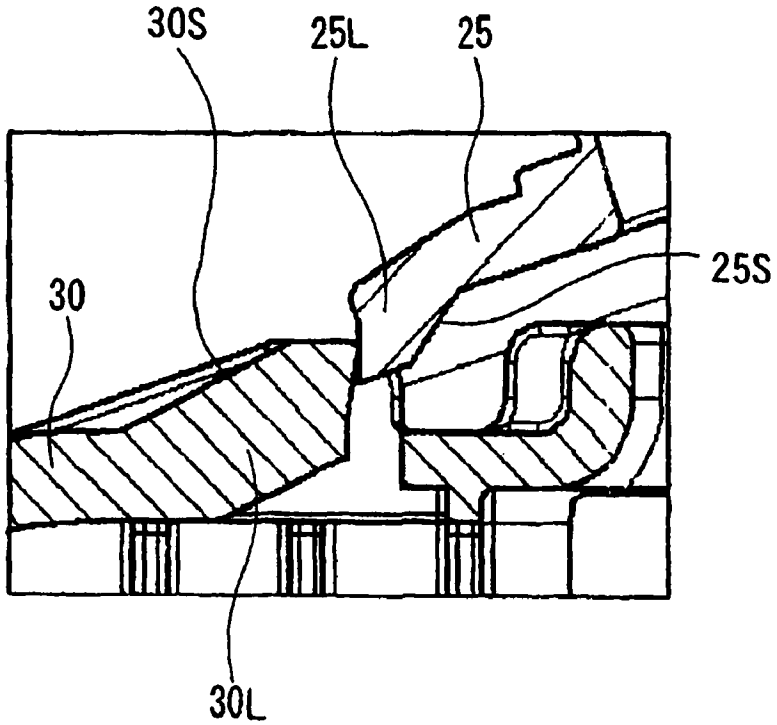
FIG. 9B is an enlarged cross-sectional view taken along line 9B-9B in the direction of arrows in FIG. 9A.
Figure 9A:
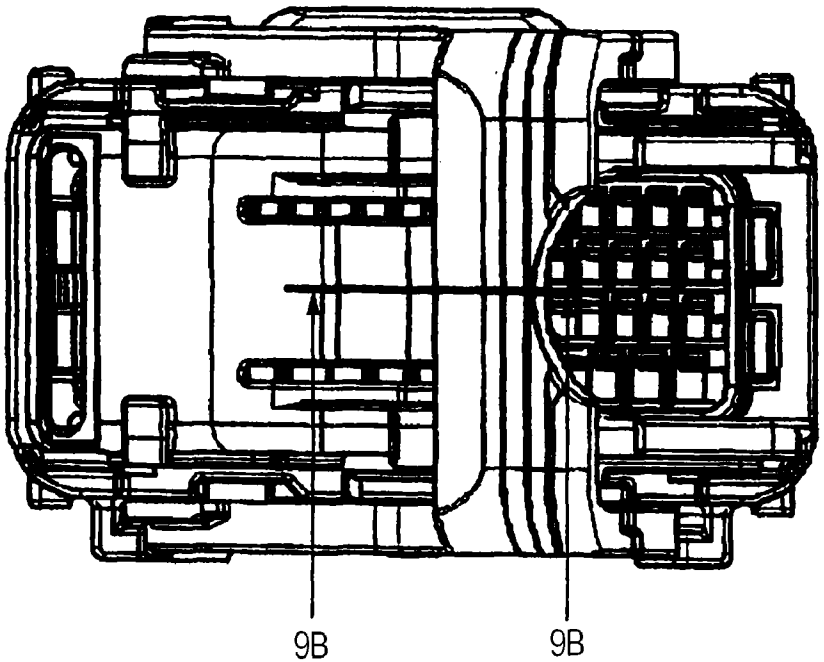
FIG. 9A is a plan view, taken from above, of the completely engaged state of the connector shown in FIG. 8B.

FIG. 9A is a plan view, taken from above, of the completely engaged state of the connector shown in FIG. 8B, and FIG. 9B is an enlarged cross-sectional view taken along line 9B-9B in the direction of arrows in FIG. 9A. In this enlarged view, the lever retaining lock 25L, which has been rotated from the lower left direction in the drawing to the center, indicated by arrow PL2 in FIG. 8B, has a slope 25S formed on its obverse side in the rotating direction, while a slope 30S is also formed on the retaining lock side of the retaining lock 30L of the wire cover 30. Therefore, during the rotation, the both slopes 25S and 30S undergo relative movement while coming into contact with each other with low contact resistance, and the lever retaining lock 25L finally rides over the retaining lock 30L and is engaged with the retaining lock 30L. FIGS. 8B, 9, and 10 show a state in which the male connector 10 and the female connector 20 are completely engaged with each other.

Figure 10B:
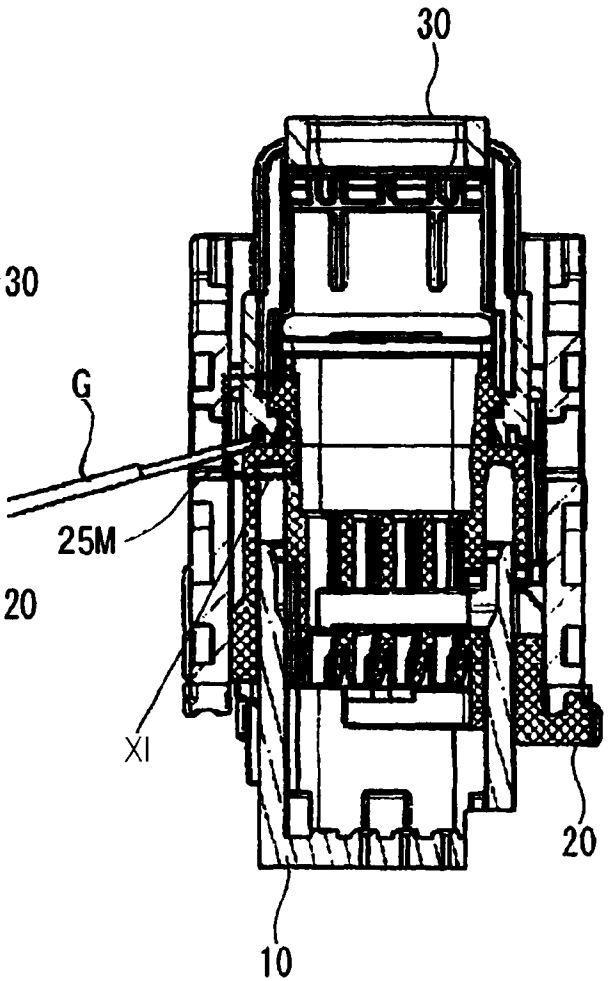
FIG. 10B is a cross-sectional view taken along line 10C-10C in the direction of arrows in FIG. 10A.
Figure 10A:
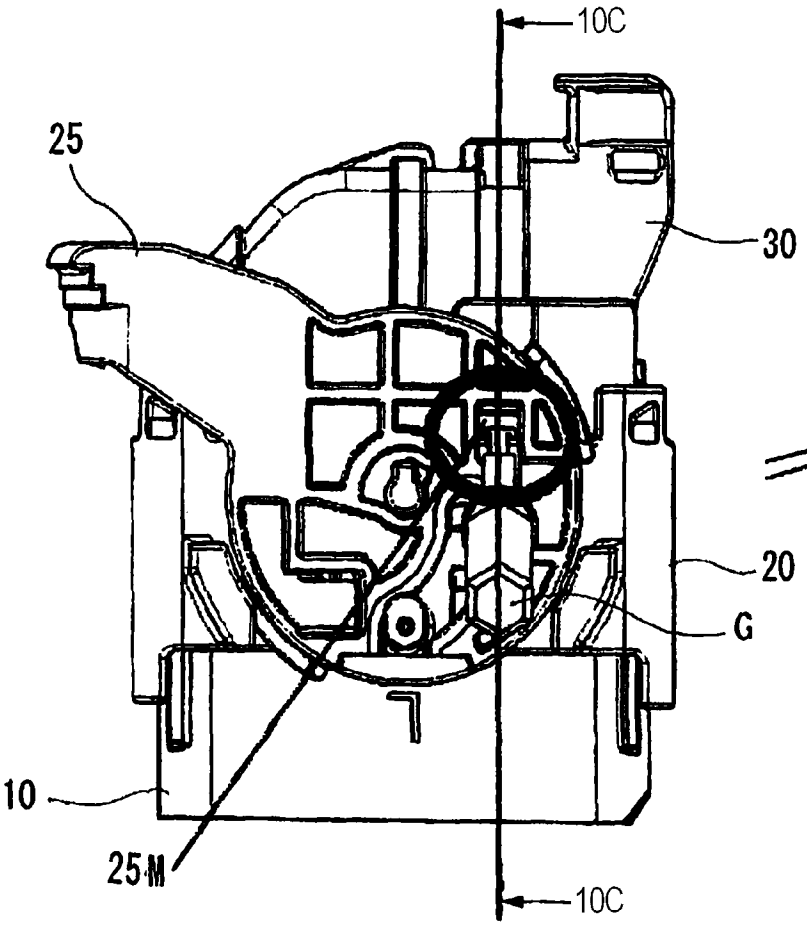
FIG. 10A is a front elevational view of the connector in the temporarily engaged state.
Figure 11A:
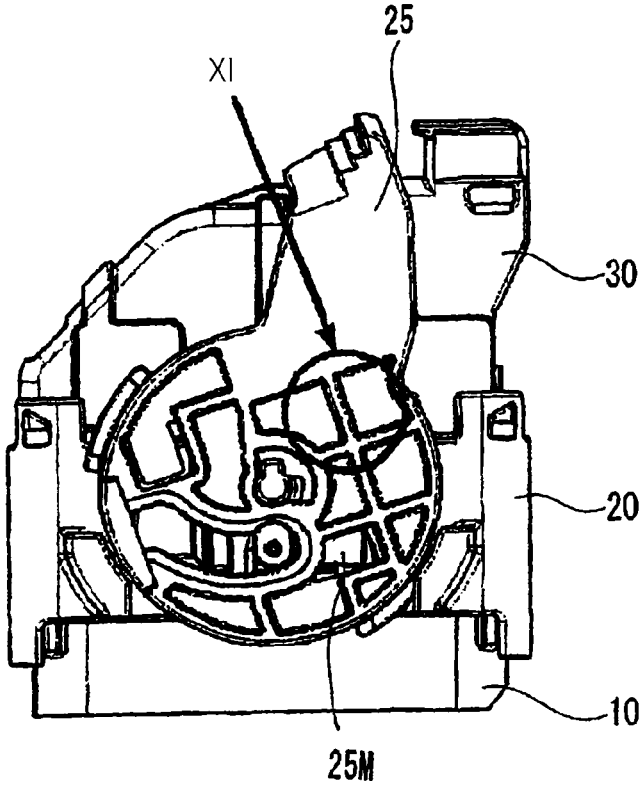
FIG. 11A is a front elevational view of the connector in the completely engaged state, and shows that the key groove is present on the reverse side of a circled portion XI.
Figure 11B:
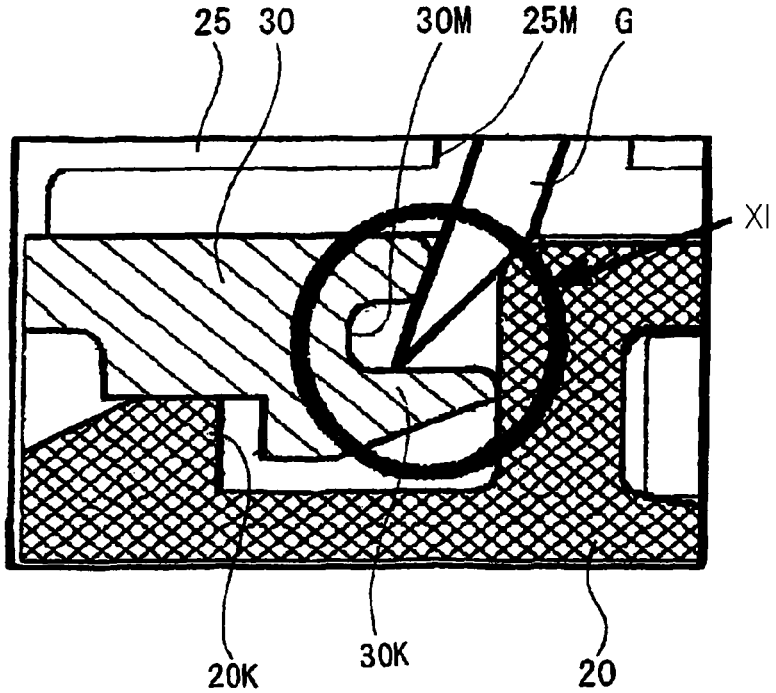
FIG. 11B is an enlarged view of that key groove portion.

FIG. 10A is a front elevational view of the connector and is similar to FIG. 8A, and FIG. 10B is a cross-sectional view taken along line 10C-10C in the direction of arrows in FIG. 10A. FIG. 11A is a front elevational view of the connector in the completely engaged state, and shows that the key groove shown in FIG. 11B is present on the reverse side of a circled portion indicated at 11A. FIG. 11B is an enlarged view of that key groove portion. To disengage the fitted wire cover from the female connector, as shown in FIGS. 10A and 10B, a tip of the disengaging jig G is inserted into an engaging portion indicated as 11A where the female connector 20 and the wire cover 30 are fitted. Then, the engaging projection 30K at the engaging portion between the female connector 20 and the wire cover 30, which is disposed at the portion of the wire cover 30, is lifted upward, as shown in FIG. 11B, to cause the engaging projection 30K to ride over the retaining projection 20K of the female connector 20, thereby allowing the disengagement.

Accordingly, in the present invention, the arrangement provided is such that a disengaging jig insertion hole 25M for insertion of the disengaging jig G is provided in the lever 25, such that when the lever 25 is in the temporarily retained state of the connector as shown in FIG. 8A, the disengaging jig insertion hole 25M is located at the engaging portion 11A between the wire cover 30 and the female connector 20. The arrangement provided is such that if the lever 25 is conversely in the completely engaged state of the connector as shown in FIG. 8B, the disengaging jig insertion hole 25M is lowered downward in the drawing and is moved away from the engaging portion between the female connector 20 and the wire cover 30.

Accordingly, when the wire cover 30 is disengaged, the lever 25 is returned to the temporarily engaged state of the connector, and if the jig G is inserted in this state into the disengaging jig insertion hole 25M, the key groove 30M provided on the wire cover 30 can be lifted upward, thereby allowing the disengagement.

Meanwhile, in a case where the lever 25 is in the position of the completely engaged state of the connector, the key groove 30M is completely covered by the lever 25, and since the disengaging jig insertion hole 25M has been moved to a different position, the jig G cannot be inserted into the key groove 30M. Therefore, the cover 30 is prevented from being disengaged.

In view of the above, the lever 25 is formed with the disengaging jig insertion hole 25M at a position where an engagement area between the retaining projection 20K and the engaging projection 30K is covered by the lever 25 in a state that the lever 25 is disposed at a position other than a predetermined position.

Referring to drawings taken from the inner sides of the lever 25 and the cover 30, a supplementary description will be given of the relationship between the lever 25 and the cover 30 described above. FIG. 12A is a view taken from the inner side when the lever is in the temporarily engaged position of the connector. FIG. 12B is a view taken from the inner side when the lever is in the completely engaged position of the connector, i.e., a view taken along line 12A-12A in the direction of arrows in FIG. 12C. FIG. 12C is a front elevational view of the lever 25 in the completely engaged position of the connector.

In the temporarily engaged state of the connector shown in FIG. 12A, the lever 25 has a substantially circular shape about its rotational center 25C, and the lever grip 26G extends in the 10 o'clock position in a clock as viewed in the drawing. An end of the curved cam opening 25T is located directly underneath, and the mating connector has not been raised by the lever 25.

The disengaging jig insertion hole 25M is at a high position in the drawing, and since the key groove 30M of the wire cover 30 is located at this position, the disengaging jig G can be inserted into the disengaging jig insertion hole 25M, as shown in FIG. 11B.

On the other hand, when in the completely engaged state of the connector shown in FIG. 12B, the lever grip 25G is located in the direction of 1 o'clock direction in a clock, so that the position of the curved cam opening 25T is higher than its position in the temporarily engaged state of the connector. The mating connector is raised upward by the lever 25 due to this difference in height, and the connectors are completely engaged. Then, the disengaging jig insertion hole 25M is downwardly lowered, and the key groove 30M of the wire cover 30 cannot be reached.

Figure 13B:
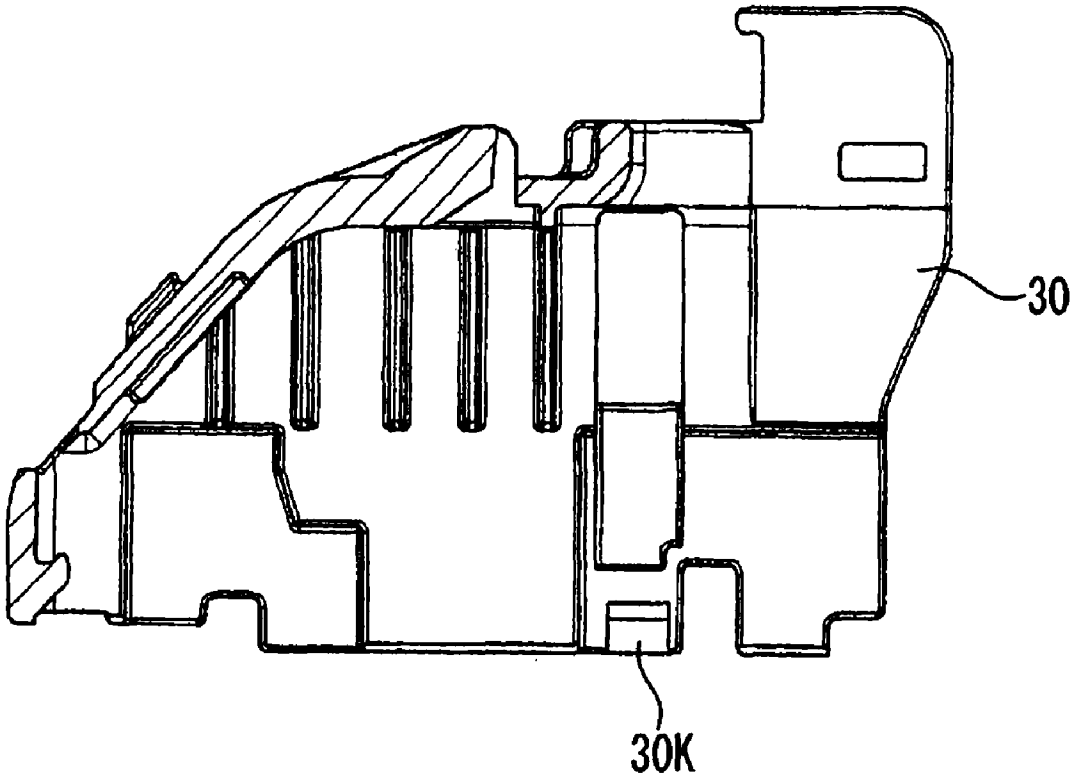
FIG. 13B is a view taken from the inner side along line 13B-13B in the direction of arrows in FIG. 13A.
Figure 13A:
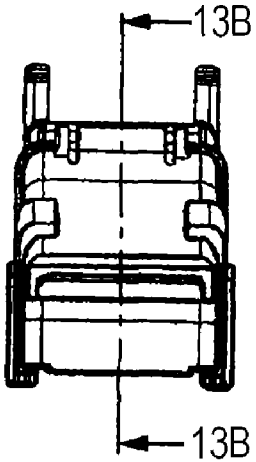
FIG. 13A is a front elevational view of the cover.

FIG. 13A is a front elevational view of the cover 30, and FIG. 13B is a view taken along line 13B-13B in the direction of arrows in FIG. 13A in view taken from the inner side. In FIG. 13B, the engaging projection 30K for engaging the retaining projection 20K is provided on the lower portion of the wire cover 30, and as the disengaging jig insertion hole 25M comes to this position at the time of temporary engagement of the connector shown in FIG. 12A, the engaging projection 30K can be accessed through this disengaging jig insertion hole 25M. However, at the time of complete engagement of the connector shown in FIG. 12B, since the disengaging jig insertion hole 25M is offset from this position and is moved downward, the engaging projection 30K cannot be accessed through this disengaging jig insertion hole 25M.

Figure 14:
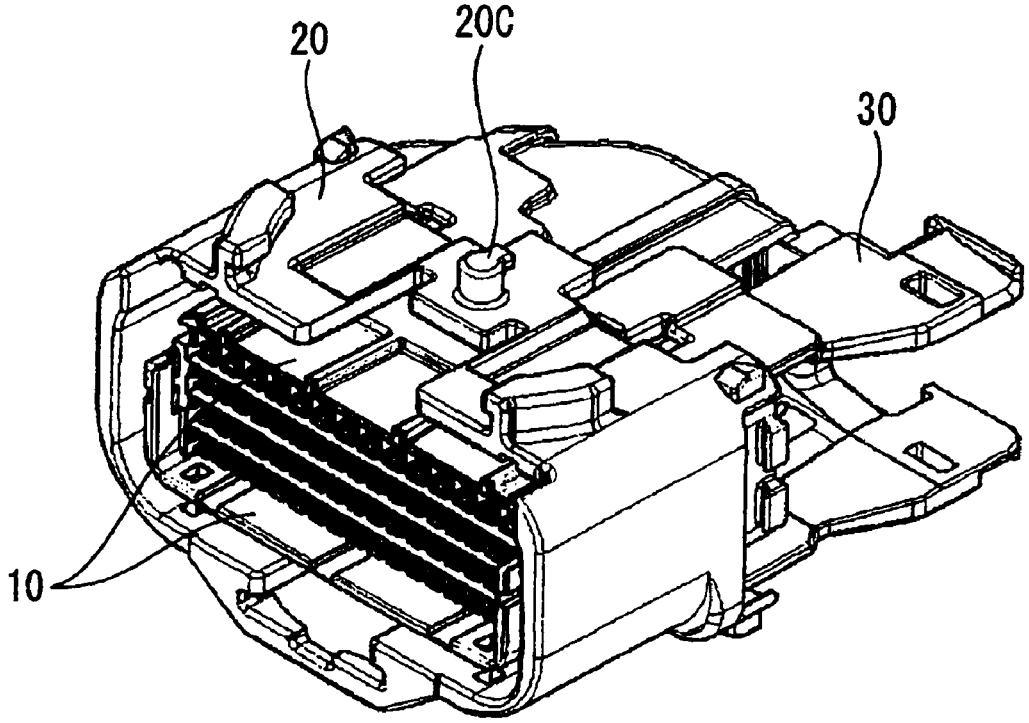
FIG. 14 is a perspective view illustrating the state in which the wire cover and the female connector are fitted with the lever removed.
Figure 15:
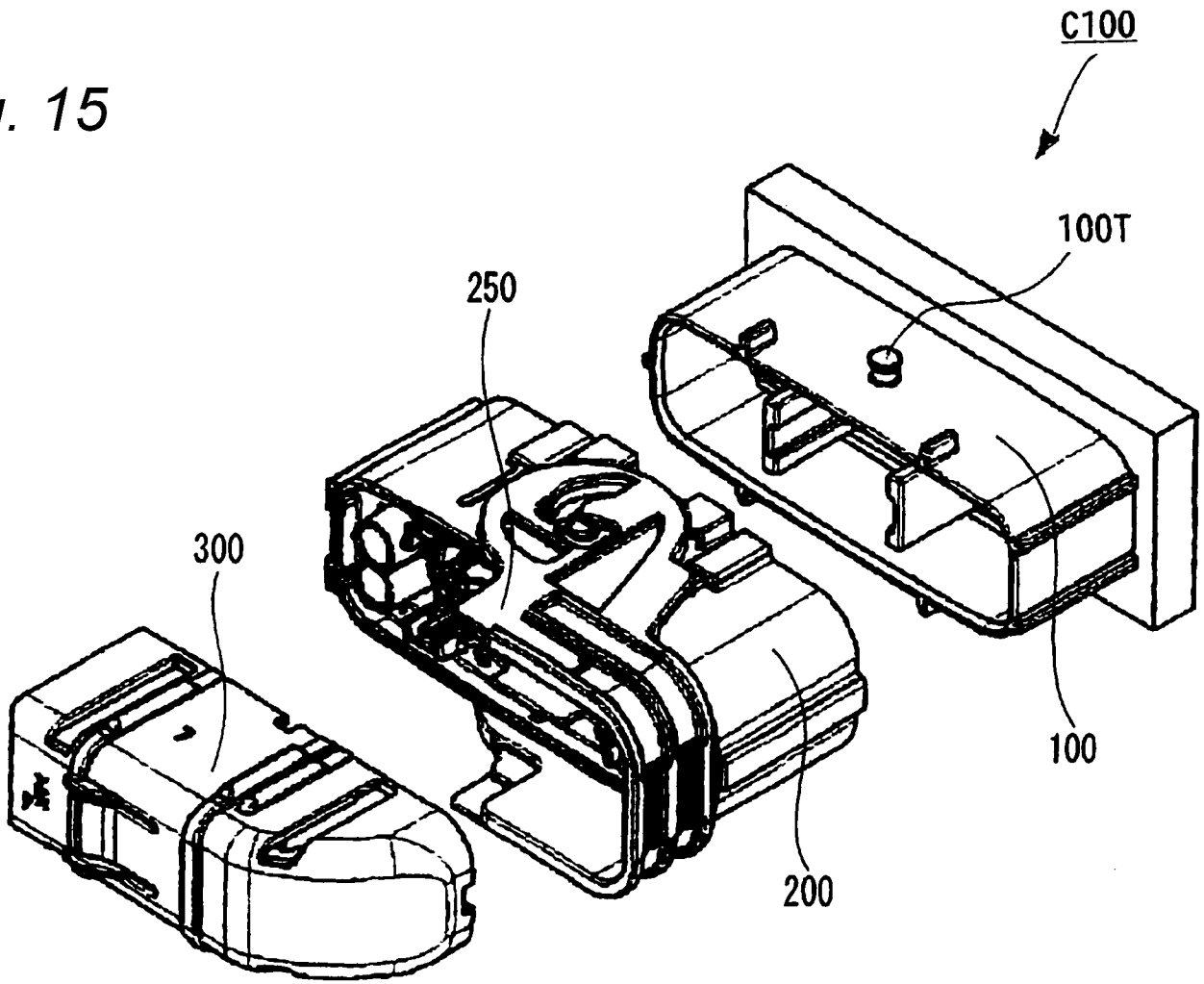
FIG. 15 is an exploded perspective view of a conventional connector.
Figure 16:
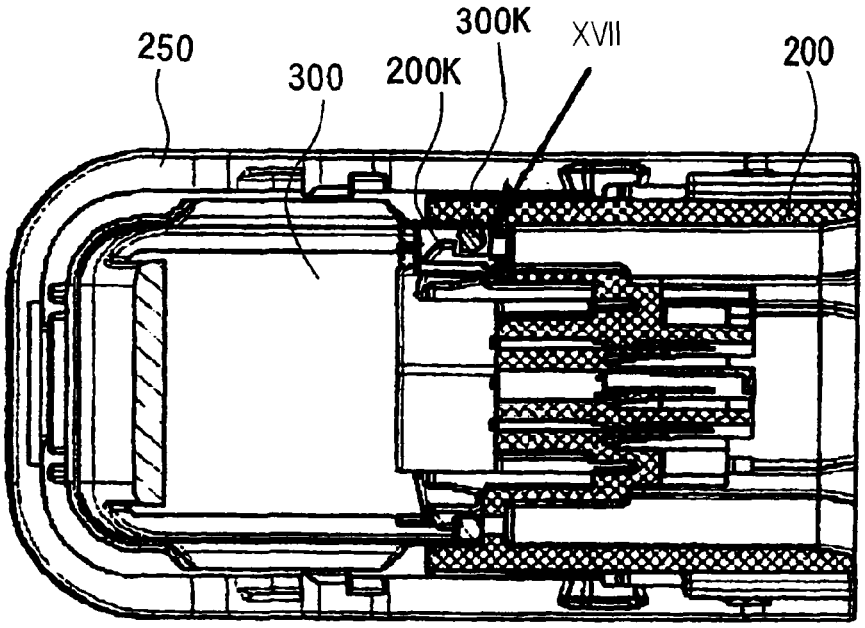
FIG. 16 is a cross-sectional plan view illustrating a state in which the wire cover is fitted to the female connector.
Figure 17:
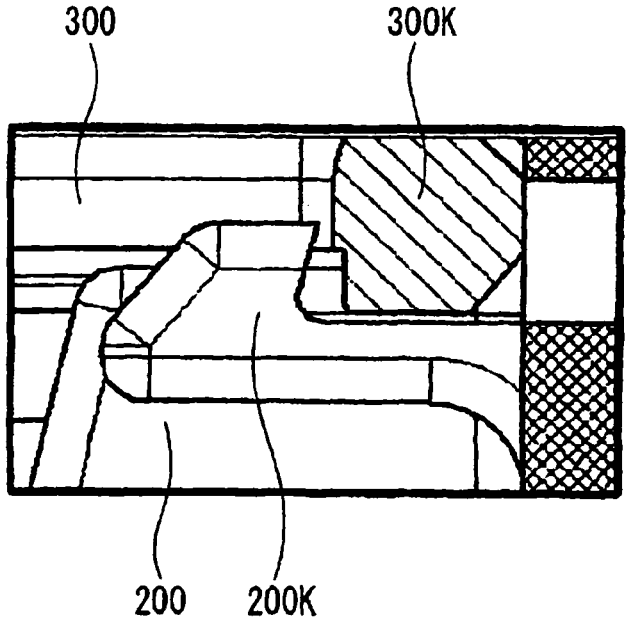
FIG. 17 is an enlarged view of an engaging portion shown in FIG. 16.
Figure 18B:
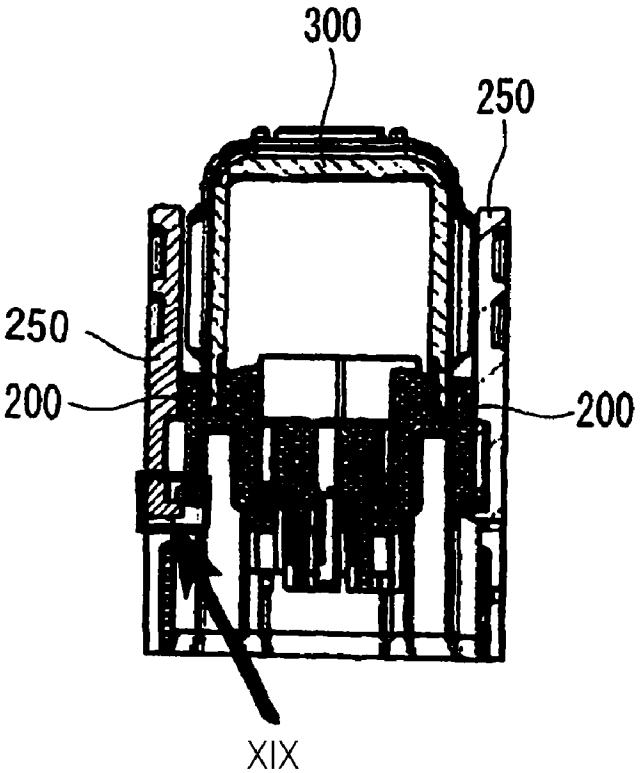
FIG. 18B is a cross-sectional view taken along line 18A-18A in the direction of arrows in FIG. 18A.
Figure 18A:
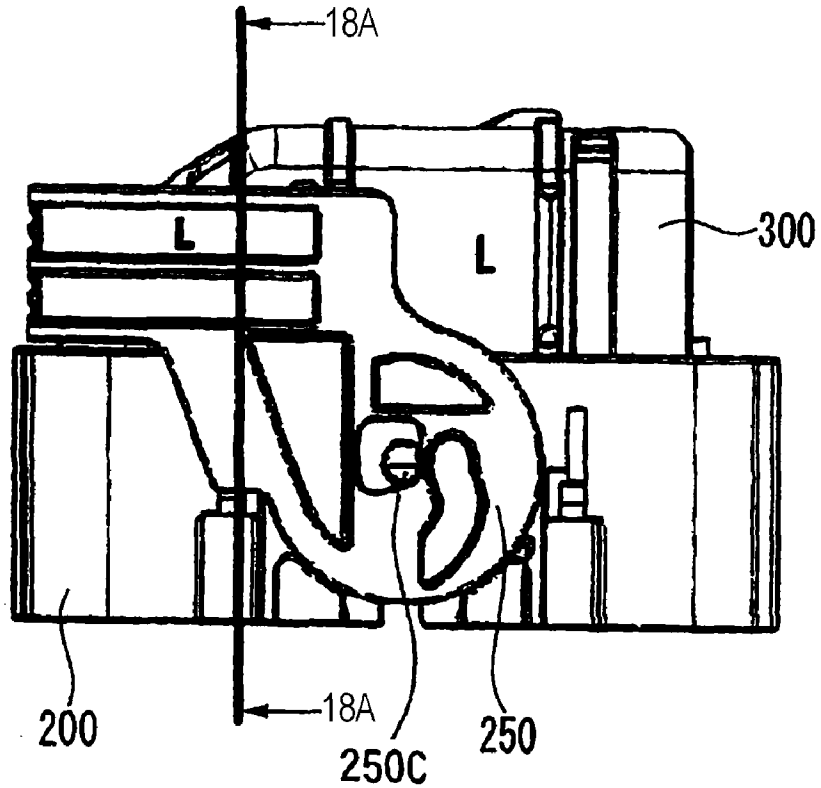
FIG. 18A is a front elevational view of a state in which the wire cover is fitted to the female connector.
Figure 19:
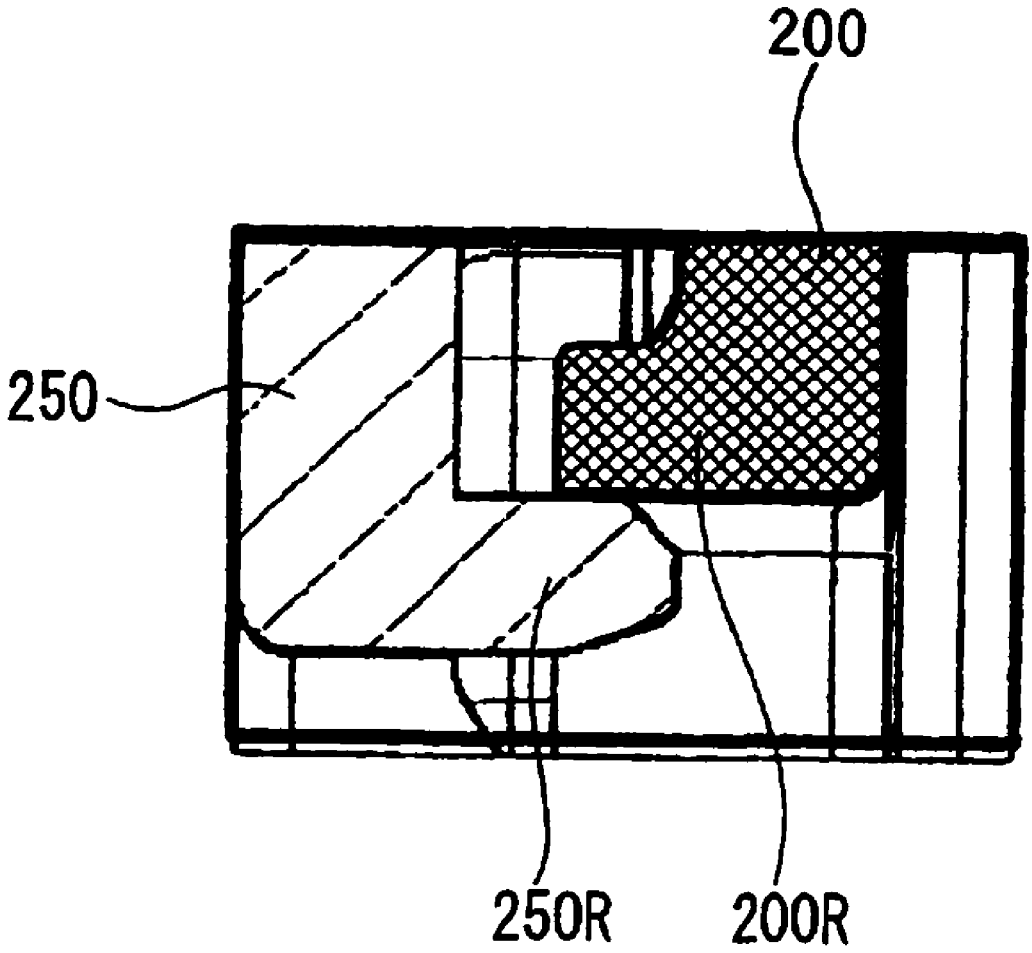
FIG. 19 is an enlarged view of a portion XIX where the lever in FIG. 18B is temporarily engaged with the female connector.
Figure 20B:
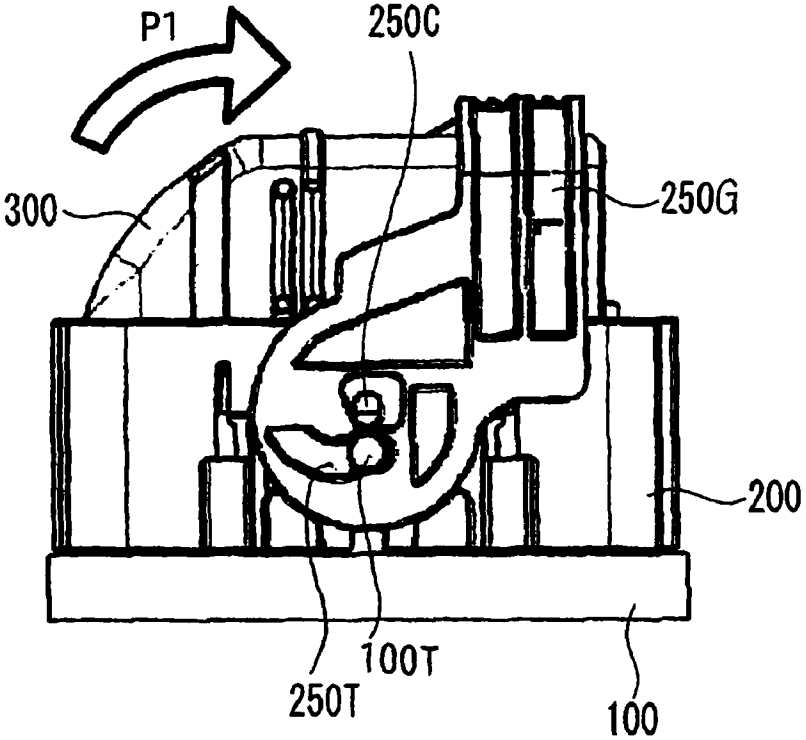
FIG. 20B is front elevational view illustrating that the male connector is engaged with the female connector in a completely engaged state.
Figure 20A:
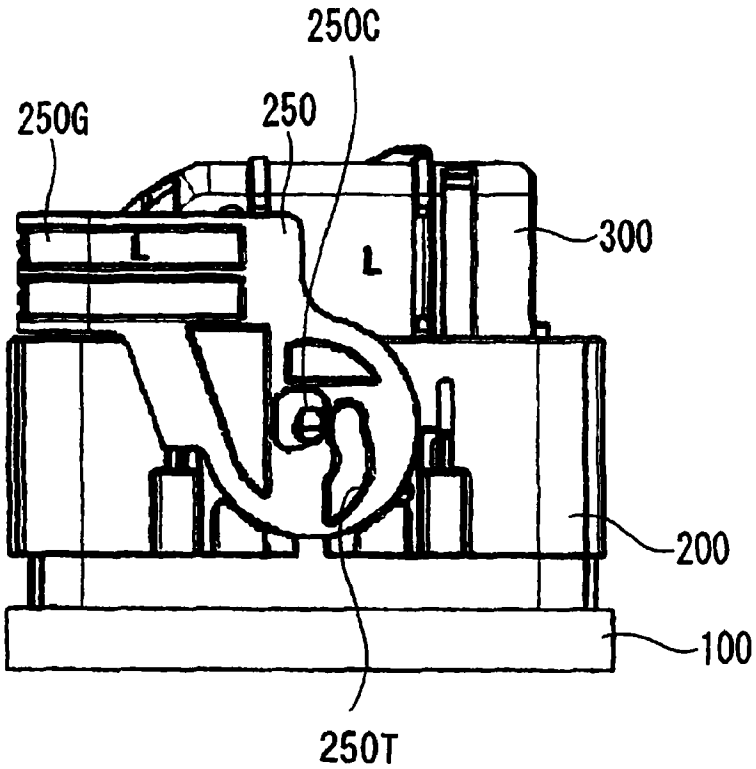
FIG. 20A is front elevational view illustrating that the male connector is engaged with the female connector in a temporarily engaged state.
Figure 21B:
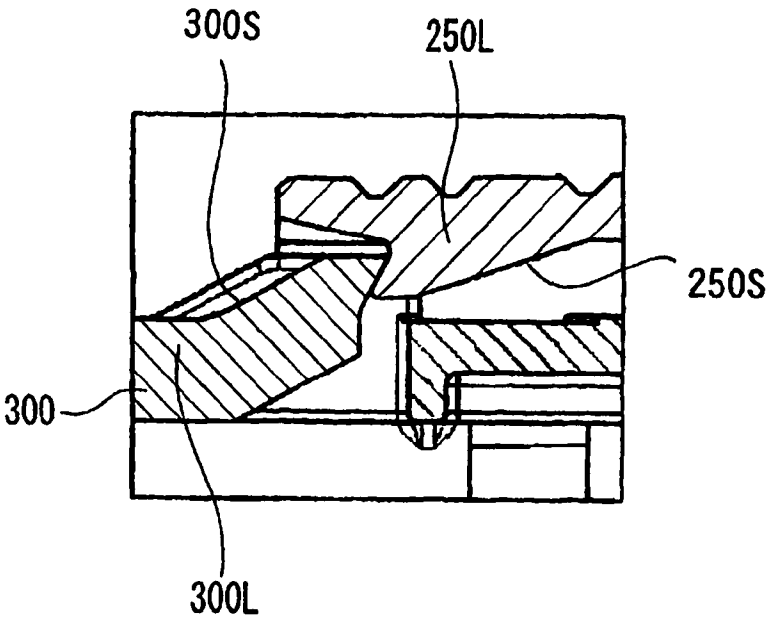
FIG. 21B is an enlarged cross-sectional view taken along line 21B-21B in the direction of arrows in FIG. 21A.
Figure 21A:
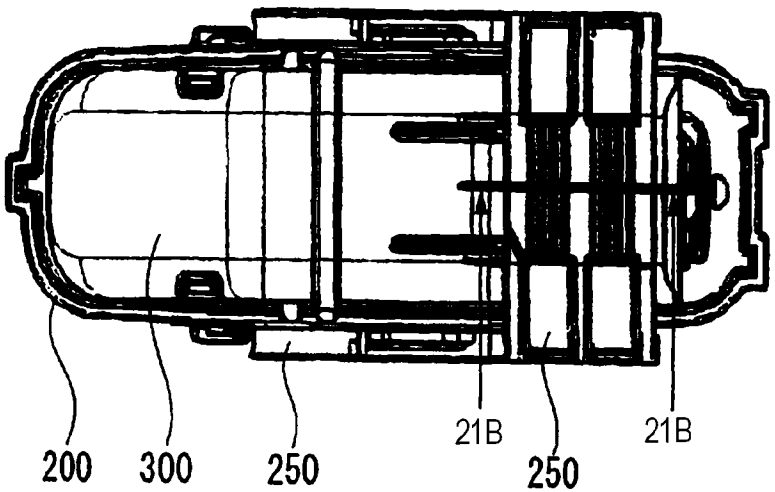
FIG. 21A is a plan view, taken from above, of the completely engaged state of the connector shown in FIG. 20B.
Figure 22:
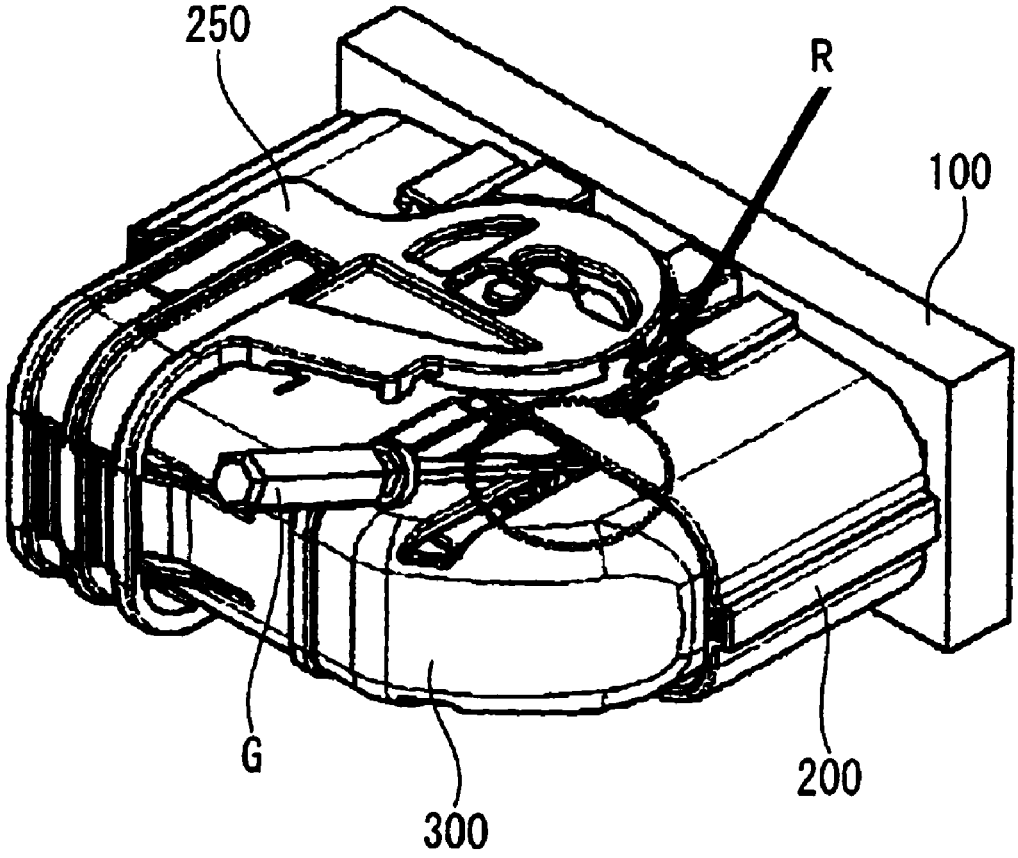
FIG. 22 is a perspective view illustrating a state in which a disengaging jig G can be disadvantageously inserted into a gap between the female connector and the engaging portion of the wire cover even in the state in which the male connector and the female connector are completely engaged.
Figure 23B:
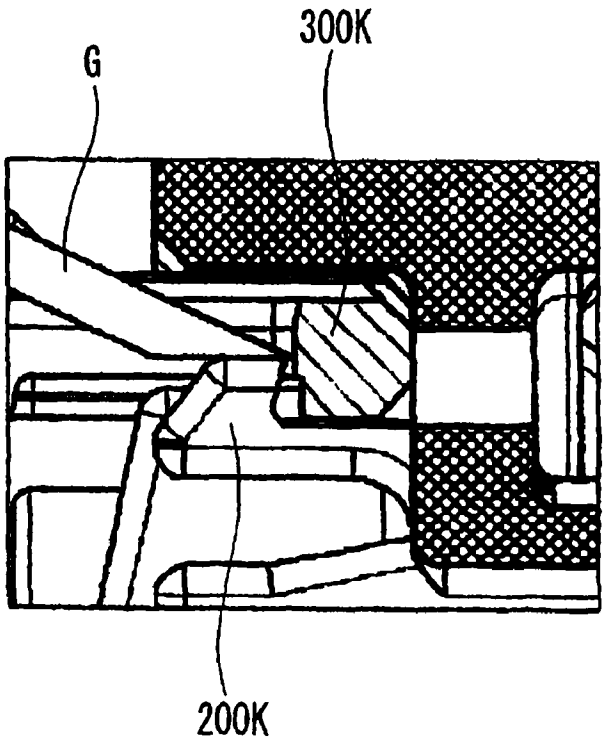
FIG. 23B is an enlarged view of an inserting portion 23B shown in FIG. 23A.
Figure 23A:
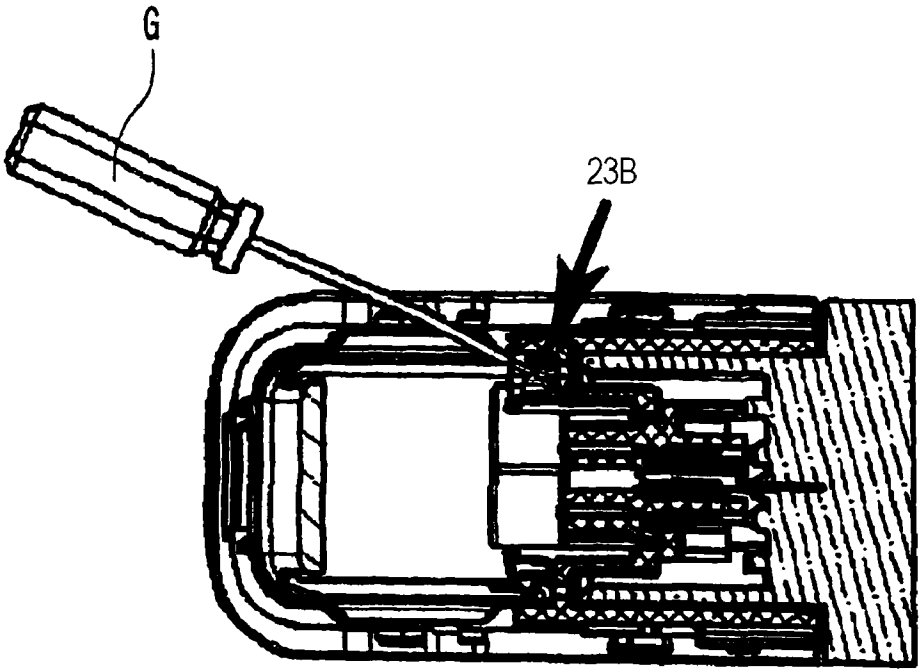
FIG. 23A is a cross-sectional plan view of the connector shown in FIG. 22.

In FIG. 14, the wire cover 30 and the female connector 20 are in a fitted state, and the engaging projection 30K is formed at their boundary of complete engagement. The engaging projection 30 can be disengaged by lifting up this portion by the jig G. Although the lever 24 having the disengaging jig insertion hole 25M is not depicted here, if the lever 25 is in the temporarily engaged position of the connector, its disengaging jig insertion hole 25M comes to be located immediately above this position, so that the engaging projection 30K can be disengaged by lifting up this portion by the disengaging jig G. Meanwhile, when the lever 25 is in the completely engaged position of the connector, since the engaging projection 25M is moved away from this position, the disengaging jig G cannot access the engaging projection 30K. Accordingly, in the case where the lever 25 is in the completely engaged state of the connector, the key groove 30M is completely covered by the lever 25, so that it is possible to prevent the occurrence of a situation where the jig G is inserted into the key groove 30M to erroneously disengage the wire cover 30.

Since it is necessary to rotate the lever 25 for disengaging the completely engaged connector up to a predetermined position to disengage the wire cover 30, it is possible prevent the inadvertent separation of the wire cover 30.

Since it is necessary to rotate the lever 25 up to an initial rotational position to remove the wire cover 30, the inadvertent separation of the wire cover 30 can be prevented most reliably.

Since the retaining portion is a retaining projection which is formed on the one connector housing, and the engaging portion formed on the wire cover 30 is a flexurally deformable engaging arm having the engaging projection 20K provided at its tip, it is possible to provide reliable engagement with a simple construction.

Since a key groove 30M into which a tip of the disengaging jig G inserted through the disengaging jig insertion hole 25M is inserted is formed in the engaging projection, by inserting the disengaging jig G into the key groove 30M, disengagement can be effected simply with a small force due to the principle of leverage.

Although only some exemplary embodiments of the invention have been described in detail above, those skilled in the art will readily appreciated that many modifications are possible in the exemplary embodiments without materially departing from the novel teachings and advantages of the invention. Accordingly, all such modifications are intended to be included within the scope of the invention.

The disclosure of Japanese Patent Application No. 2009-234430 filed Oct. 8, 2009 including specification, drawings and claims is incorporated herein by reference in it is entirety.

What is claimed is:

1. A lever engagement type connector, comprising;

a first connector housing having a retaining portion;

a second connector housing;

a lever rotatably attached to the first connector housing and formed with a cam groove;

an engagement pin projected on the second connector housing and configured to be engaged with the cam groove;

a wire cover attached to the first connector housing; and an engagement portion provided in the wire cover and configured to be engaged with the retaining portion, wherein the lever is formed with a jig insertion hole at a position where an engagement area between the retaining portion and the engagement portion is covered by the lever in a state that the lever is disposed at a position other than a predetermined position the retaining portion is a retaining projection formed on the first connector housing, the engagement portion is an engagement arm which is formed with an engagement projection and deformable, the engagement projection is formed with a key groove, and a tip of a disengaging jig is inserted into the key groove through the jig insertion hole.

2. A lever engagement type connector, comprising;

a first connector housing having a retaining portion;

a second connector housing;

a lever rotatably attached to the first connector housing and formed with a cam groove;

an engagement pin projected on the second connector housing and configured to be engaged with the cam groove;

a wire cover attached to the first connector housing; and an engagement portion provided in the wire cover and configured to be engaged with the retaining portion, wherein the lever is formed with a jig insertion hole at a position where an engagement area between the retaining portion and the engagement portion is covered by the lever in a state that the lever is disposed at a position other than a predetermined position, the predetermined position is an initial rotational position of the lever, the retaining portion is a retaining projection formed on the first connector housing, the engagement portion is an engagement arm which is formed with an engagement projection and deformable, the engagement projection is formed with a key groove, and a tip of a disengaging jig is inserted into the key groove through the jig insertion hole.

* * * * *